United States Patent [19]

Ditzig

[11] Patent Number: 4,764,121

[45] Date of Patent: Aug. 16, 1988

[54] ROTARY ELECTRICAL CONNECTOR

[75] Inventor: Albert Ditzig, Hoffman Estates, Ill.

[73] Assignee: Telephone Products, Inc., Wheeling, Ill.

[21] Appl. No.: 22,379

[22] Filed: Mar. 5, 1987

Related U.S. Application Data

[63] Continuation-in-part of Ser. No. 809,217, Dec. 16, 1985, Pat. No. 4,673,228.

[51] Int. Cl.[4] ..... H01R 39/02

[52] U.S. Cl. ..... 439/21; 29/883; 439/26; 439/29

[58] Field of Search ..... 439/1, 4, 5, 6, 10, 439/13, 18, 20, 21, 23–26, 29, 676; 29/883, 885

[56] References Cited

U.S. PATENT DOCUMENTS

| | | | |
|---|---|---|---|
| 3,243,866 | 4/1966 | Pandapas et al. | 29/597 |
| 3,430,180 | 2/1969 | Brown | 439/23 |
| 3,437,976 | 4/1969 | Nelson | 439/23 |
| 3,686,514 | 8/1972 | Dube et al. | 439/20 X |
| 4,438,998 | 3/1984 | Myers | 439/638 |
| 4,472,010 | 11/1984 | Parnello | 439/14 |
| 4,533,796 | 10/1985 | Engelmore | 439/24 |
| 4,583,797 | 4/1986 | Engelmore et al. | 439/22 |
| 4,583,798 | 4/1986 | Blazowich | 439/24 |

*Primary Examiner*—Eugene F. Desmond

*Attorney, Agent, or Firm*—Marshall, O'Toole, Gerstein, Murray & Bicknell

[57] ABSTRACT

A rotary electrical connector for a telephone or the like comprises a spindle assembly and a housing mounted in rotating relation to each other. A first male or female connector element is fixed to the spindle assembly, and a second male or female connector element rotates with the housing. Electrical contact elements extend from the first connector element an engage rings disposed in peripheral grooves of a spindle body. The rings are electrically connected to the second connector element by conducting elements extending through channels or grooves in the spindle body or in holders carried by the spindle body. Another embodiment of spindle assembly has flat planar conducting elements embedded therein. Methods for producing various embodiments are disclosed.

34 Claims, 7 Drawing Sheets

FIG. 17
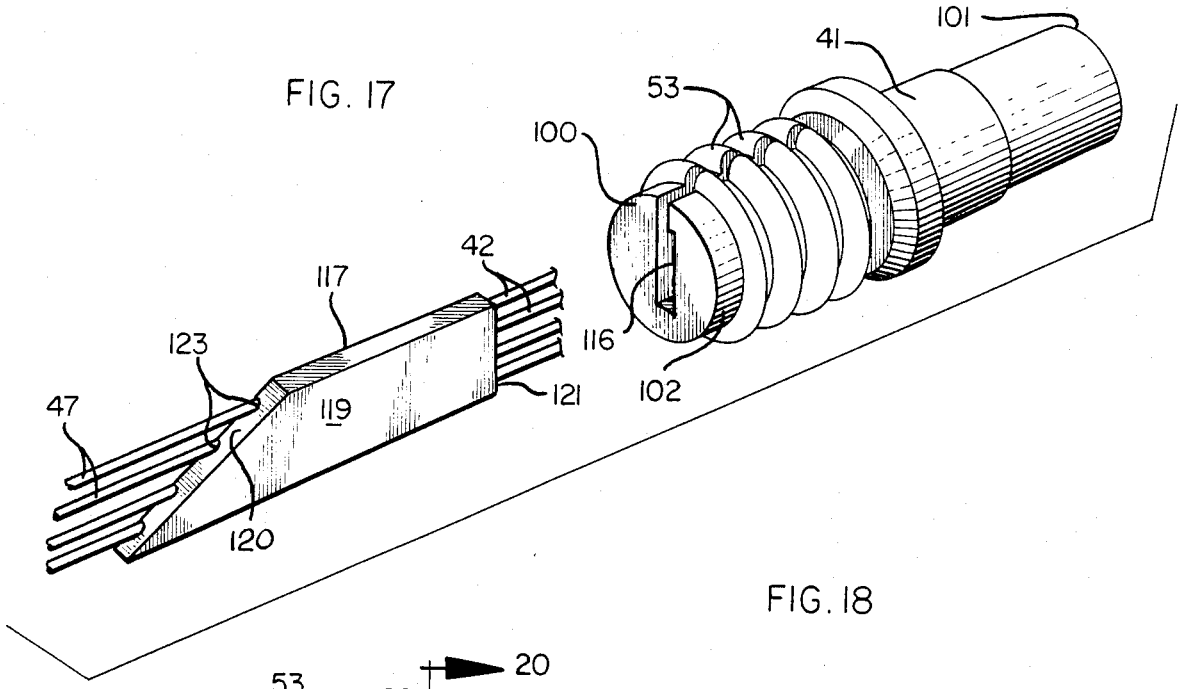
FIG. 18
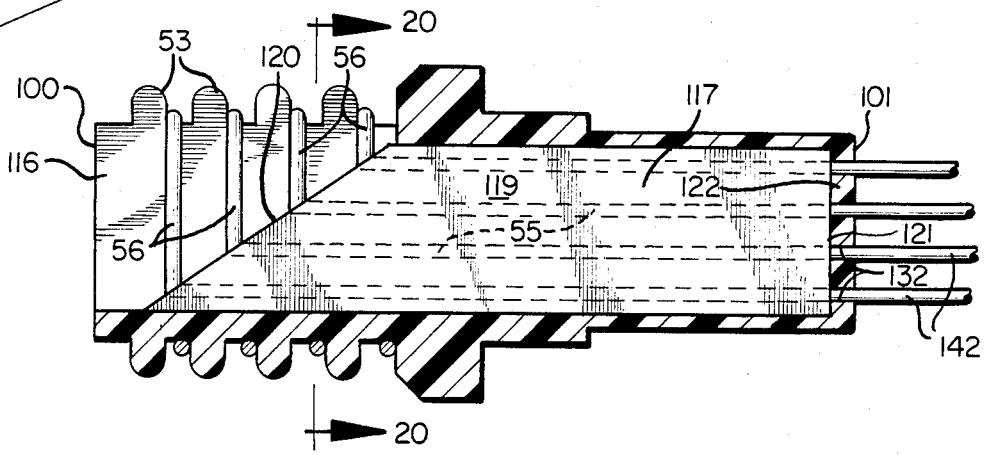
FIG. 19
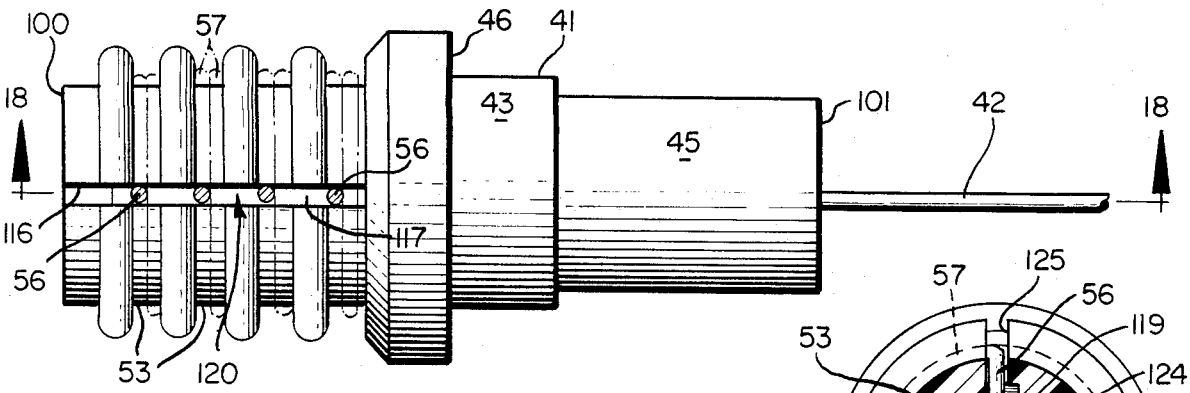
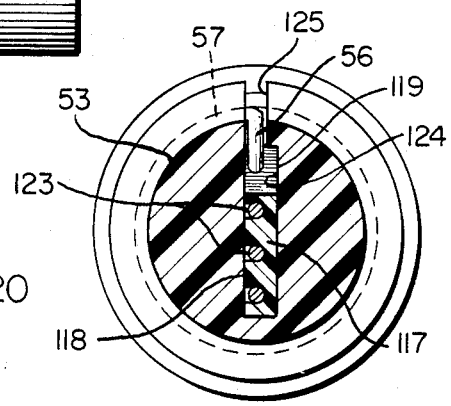
FIG. 20

FIG. 21
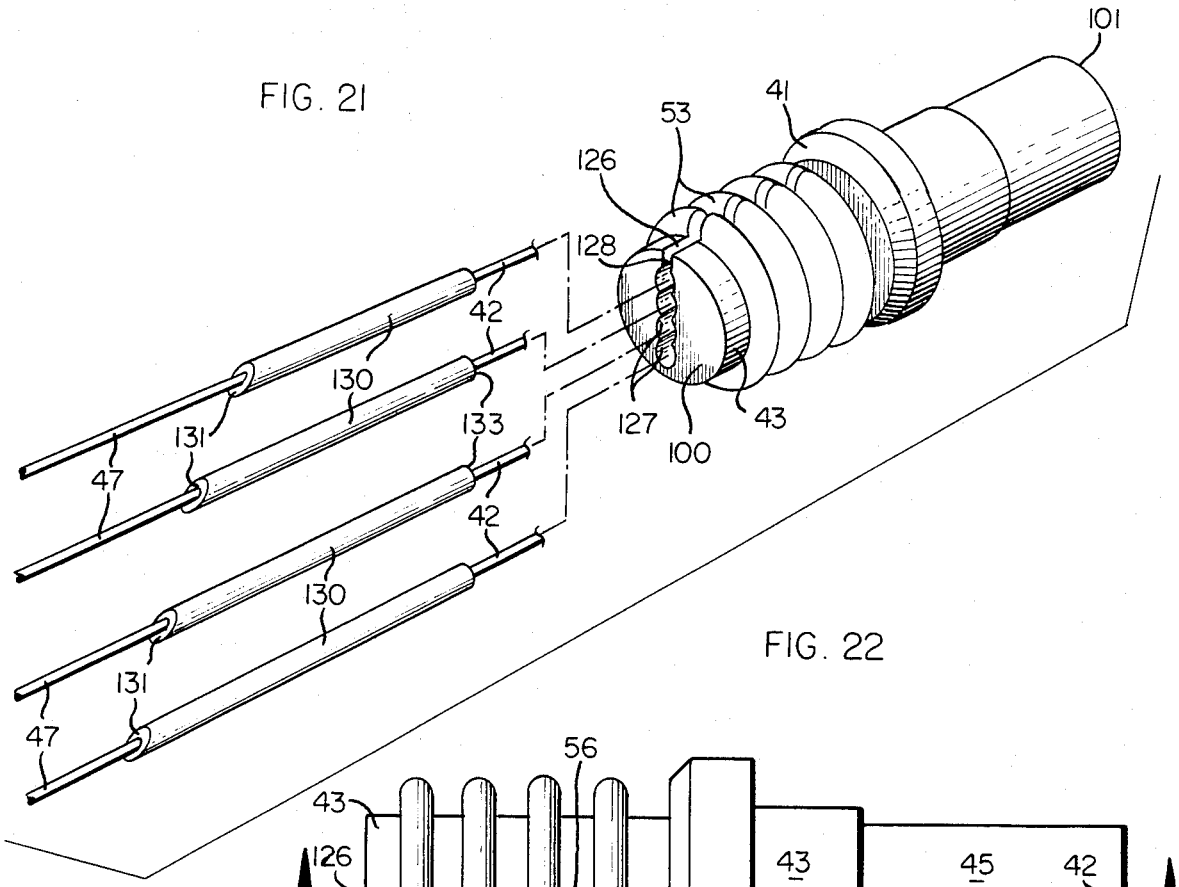
FIG. 22
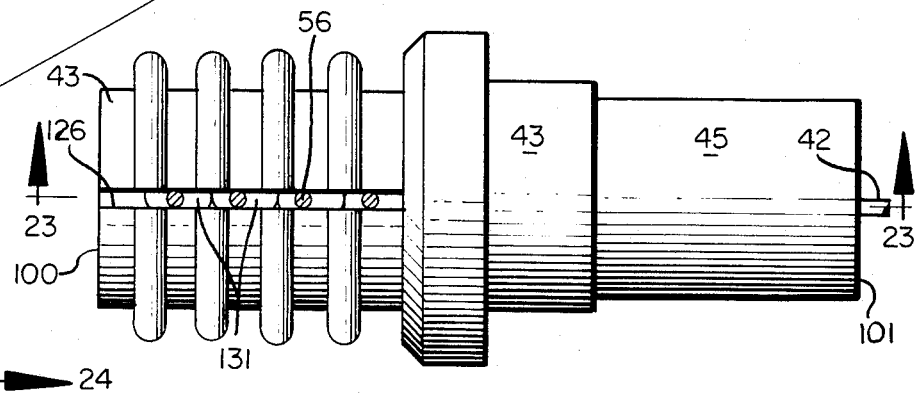
FIG. 23
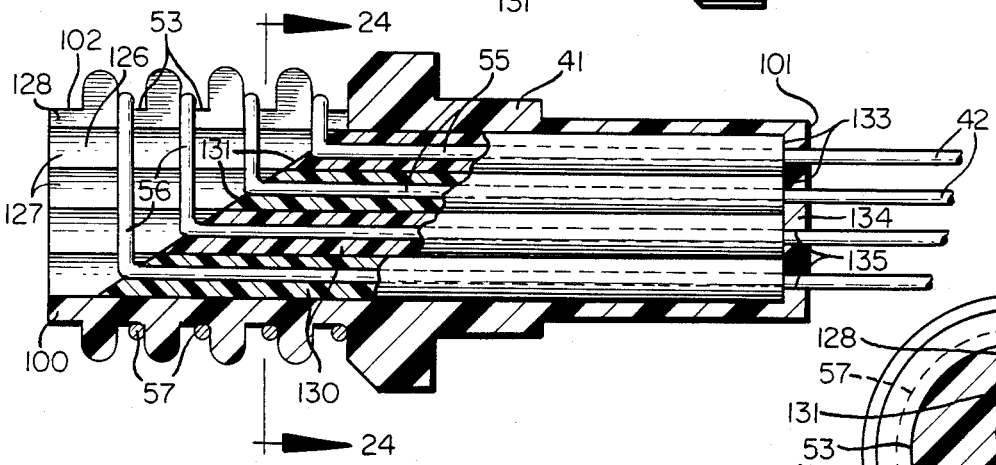
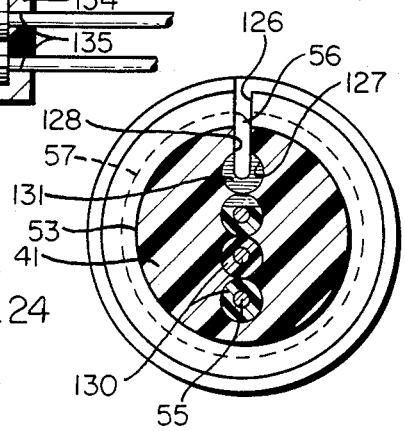
FIG. 24

ROTARY ELECTRICAL CONNECTOR

RELATED APPLICATION

This is a continuation-in-part of application Ser. No. 809,217 filed Dec. 16, 1985 and entitled "ROTARY ELECTRICAL CONNECTOR APPARATUS", now U.S. Pat. No. 4,673,228 issued June 16, 1987, and the disclosure thereof is incorporated herein by reference.

BACKGROUND OF THE INVENTION

The present invention relates generally to electrical connectors for connecting a power or communication cord to an appliance or telecommunications equipment and more particularly to a rotary electrical connector for such use.

A rotary electrical connector is used, for example, in conjunction with a cord that connects the handset to the base of the telephone. The purpose of the rotary electrical connector is to prevent the cord from becoming tangled or twisted when used over an extended period of time, which is undesirable.

Rotary connectors generally comprise a spindle at least part of which is contained within a housing. Either the spindle or the housing is mounted for rotation in relation to the other, about a common axis. Male and female modular electrical connector elements are associated with one or the other of the housing and the spindle. That part of the spindle located within the housing has electrically conductive rings located around the periphery of the spindle, and these rings are connected by electrical conducting elements extending through the spindle to electrical contact members on one of the modular connector elements. The rings are engaged by other electrical contact members electrically connected to further contact members on the electrical connector element associated with the housing. There is thus formed a rotatable electrical connection between the modular male and female connector elements. The female connector element associated with the rotary connector receives a modular male connector element normally located at one end of a telephone cord, and the male modular connector element associated with the rotary connector normally plugs into a female connector element on the telephone, either the hand set or the base.

Most rotary electrical connectors of the type described above are relatively complicated assemblies containing a relatively large number of parts which are difficult to assemble and have operating difficulties.

SUMMARY OF THE INVENTION

A rotary electrical connector in accordance with the present invention has a relatively minimal number of parts. It is relatively simple to assemble, and it has optimum operating characteristics. There are a number of improved structural features incorporated into a rotary electrical connector constructed in accordance with the present invention. Among these features are the provision of grooves in the periphery of the spindle to receive the conductive rings, and a notch in a side wall of the groove for retaining the conductive ring within the groove.

Another feature is structure for imparting torsion to the contact member which engages the ring, to urge the contact member against the ring.

A further feature is the provision of structure which permits the adjustment of a ring-engaging contact member in an axial direction to facilitate alignment of the contact member with the particular ring it is intended to engage.

Another feature is the employment of a ring which is integral with the electrical conducting element connecting the ring to the modular connector element, and the provision of structure which facilitates the assembly of all the integral ring-conducting elements with the spindle.

Still another feature is a method for manufacturing a spindle assembly.

Other features and advantages are inherent in the structure and method claimed and disclosed or will become apparent to those skilled in the art from the following detailed description in conjunction with the accompanying diagrammatic drawings.

BRIEF DESCRIPTION OF THE DRAWINGS

FIG. 17 is an exploded perspective of a further embodiment of a spindle assembly in accordance with the present invention;

FIG. 18 is a sectional view of the embodiment of FIG. 17 taken along line 18—18 in FIG. 19;

FIG. 19 is a side elevational view of the embodiment of FIG. 17;

FIG. 20 is a sectional view taken along line 20—20 in FIG. 18;

FIG. 21 is an exploded perspective of still another embodiment of a spindle assembly in accordance with the present invention;

FIG. 22 is a side elevational view of the embodiment of FIG. 21;

FIG. 23 is a sectional view, partially cut away, taken along line 23—23 in FIG. 22; and FIG. 24 is a sectional view taken along line 24—24 in FIG. 23.

DETAILED DESCRIPTION

Figure 1:
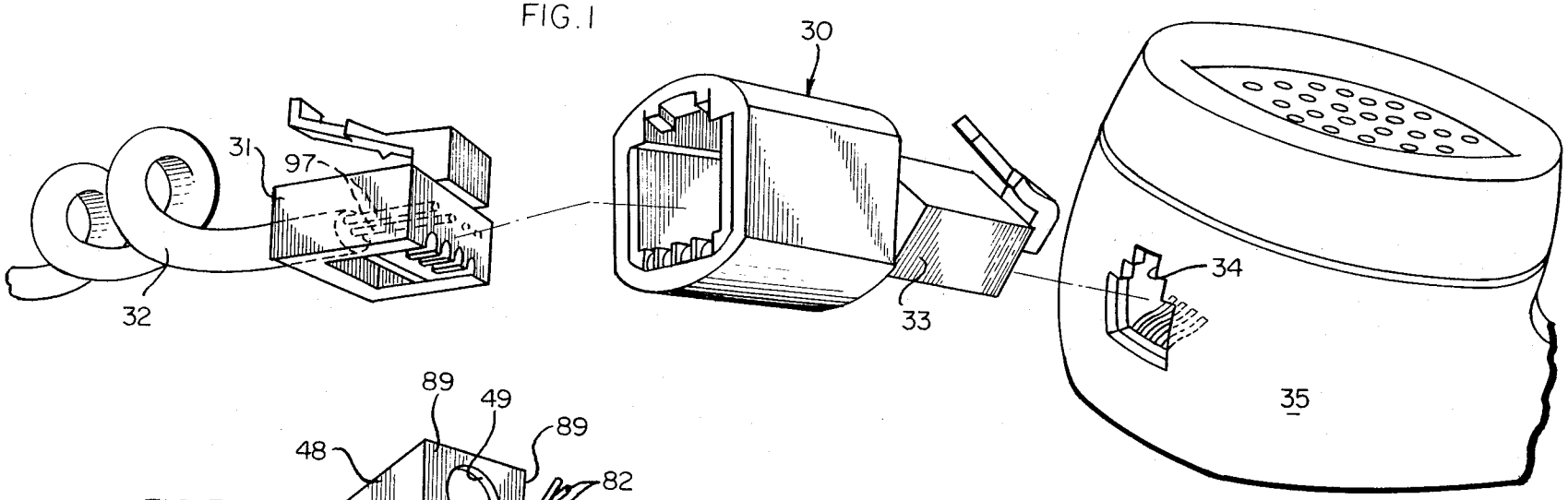
FIG. 1 is a perspective illustrating an embodiment of a rotary electrical connector in accordance with the present invention and associated telephone parts.

Referring initially to FIG. 1, indicated generally at 30 is a rotary electrical connector constructed in accordance with an embodiment of the present invention and shown in use with a telephone. Rotary connector 30 receives a male modular connector element 31 located at one end of a telephone cord 32. Associated with rotary electrical connector 30 is a male connector element 33 received within a socket 34 in a telephone hand set 35. The other end of telephone cord 32 (not shown) is connected to the base of the telephone set.

The arrangement illustrated in FIG. 1 could, of course, be reversed so that the other end of cord 32 is connected to hand set 35 and so that male connector element 33, associated with the rotary electrical connector, would plug into a socket similar to 34 in the base of the telephone.

Figure 2:
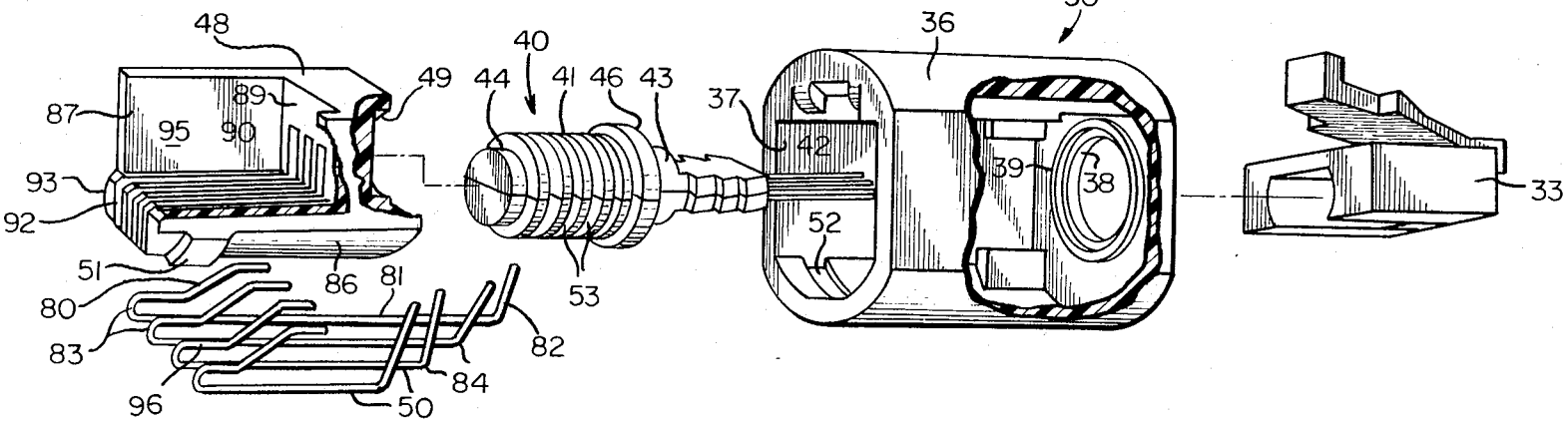
FIG. 2 is an exploded perspective of an embodiment of a rotary electrical connector in accordance with the present invention.
Figure 4:
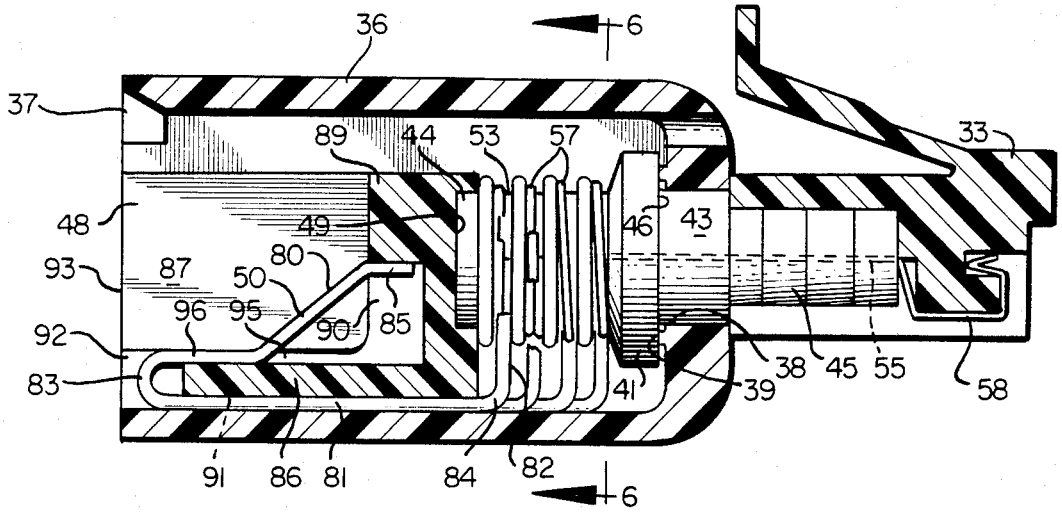
FIG. 4 is a sectional view of the rotary electrical connector.
Figure 5:
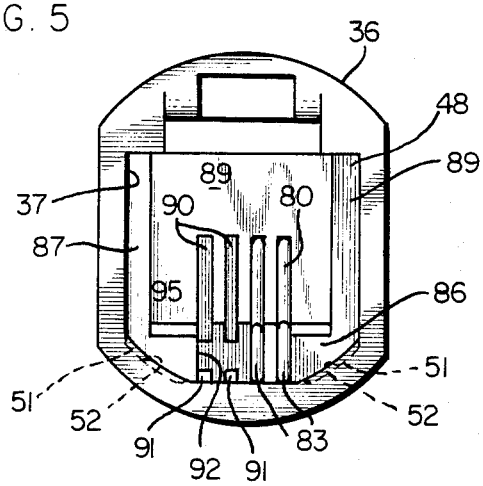
FIG. 5 is an end view as viewed from the left in FIG. 4.

Referring now to FIGS. 2 and 4, rotary connector 30 comprises a housing 36 having first and second opposite open ends 37, 38 respectively. Rotatably mounted within housing 36 is a spindle assembly 40 comprising a spindle body 41 which carries a plurality of electrical conducting elements 42, 42. Spindle body 41 comprises a first bearing portion 43 located between the opposite ends of the spindle body and a second bearing portion 44 located at one end of the spindle body. Extending integrally from first bearing portion 43 is a shank portion 45. When the spindle and the housing are assembled together, first bearing portion 43 is rotatably mounted within housing opening 38, and shank portion 45 extends outwardly from opening 38, to the right as viewed in FIG. 4.

The spindle body's second bearing portion 44 is rotatably mounted within a recess 49 located at one end of a female connector element 48 which carries a plurality of electrical contacting elements 50, 50 which, together with the engagement of the spindle's second bearing portion 44 within recess 49, attaches female connector element 48 and spindle assembly 40 together, in a manner to be subsequently described in greater detail.

Female connector element 48 and spindle assembly 40 are initially attached together, and they are then inserted into housing 36 through its first open end 37. When female connector element 48 and spindle assembly 42 are assembled within housing 30, they assume the positions shown in FIG. 4.

As assembled, female connector element 48 is contained within and supported by housing 36. Female connector element 48 in turn rotatably supports one end of spindle assembly 40, where the spindle's second bearing portion 44 is engaged within recess 49 in the female connector element. The other rotatable support for spindle assembly 40 within housing 36 is the engagement of first bearing portion 43 within second open end 38 of housing 36. As shown in FIG. 4, spindle shank 45 projects outwardly from housing 36 beyond the latter's second open end 38. Male connector element 33 is mounted on shank 45 after all of the other elements shown in FIG. 4 are assembled in the positions shown there.

Figure 3:
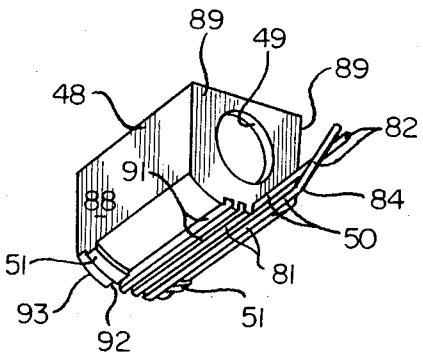
FIG. 3 is a perspective of a female electrical connector element associated with the rotary electrical connector.

Movement of spindle assembly 40 in an axial direction to the right as shown in FIG. 4 is prevented by the engagement of a ring-like thrust bearing 39, located on the interior of housing 36 around second open end 38, with a thrust bearing 46 on spindle body 41, located adjacent the spindle's first bearing portion 43. Movement of spindle assembly 40 in an axial direction to the left as viewed in FIG. 4 is prevented by the spindle body's engagement with female connector element 48, and movement of female connector element 48 in an axial direction to the left in housing 36 is prevented by the engagement of a pair of projections 51, 51 on the bottom of the female connector element (FIGS. 2 and 3) with a pair of slots 52, 52 on the bottom of housing 36 adjacent its first open end 37 (FIG. 2).

When all the elements are fully assembled as shown in FIG. 4, spindle assembly 40 and male connector element 33 are rotatable together relative to female connector element 48 and housing 36, about a common axis.

Housing 36, female connector element 48, spindle body 41 and male connector element 33 are all composed of electrical insulating material such as molded plastic. Electrical conducting elements 42, 42 and electrical contact elements 50, 50 are, of course, composed of a conductive metal such as copper or the like which may be gold plated to enhance corrosion resistance, or one may employ a high corrosion resistant copper-nickel-silver alloy such as 725 copper alloy.

Figure 6:
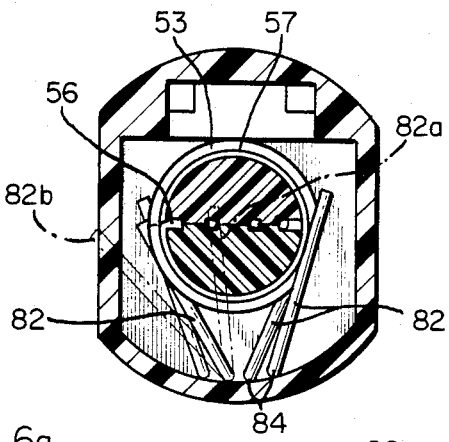
FIG. 6 is a sectional view taken along line 6—6 in FIG. 4.
Figure 7:
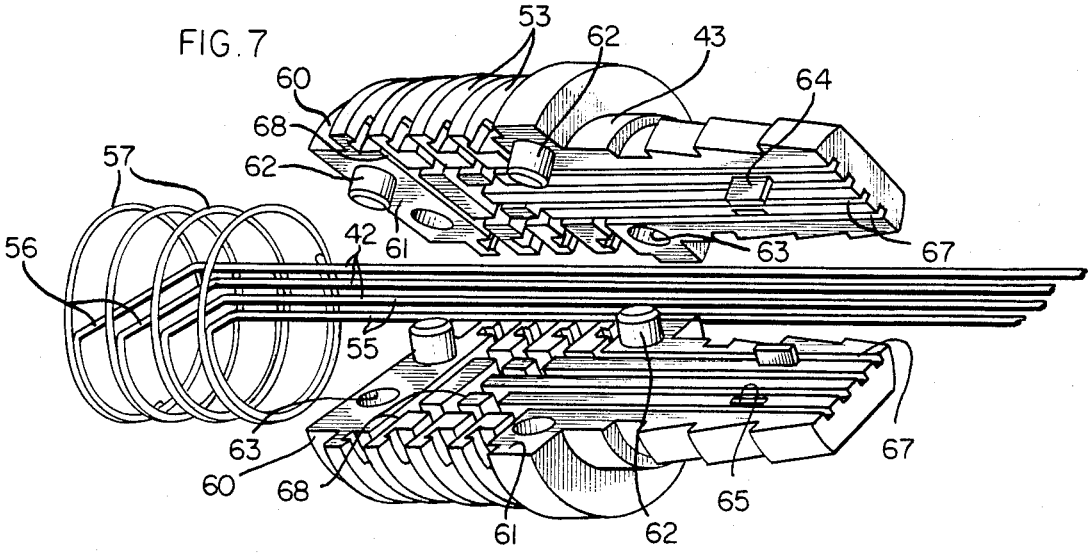
FIG. 7 is an exploded perspective illustrating a spindle assembly in accordance with an embodiment of the present invention.

Referring now to FIGS. 2, 4 and 6–7, spindle body 41 has a plurality of peripheral grooves 53, 53 in the spindle body's outer surface. As best shown in FIG. 7, each electrical conducting element 42, 42 has a linear first portion 55 extending through spindle body 41 in a direction substantially parallel to the axis of the spindle, a second portion 56 extending transversely from first portion 55 through the outer surface of the spindle body and a ring portion 57 integral with second portion 56 and received in a respective peripheral groove 53 on the outer surface of the spindle body. Integral with an electrical conducting element's first portion 55 is a terminal end portion 58 shaped to conform to and engage with male connector element 33 (FIG. 4).

With further reference to FIG. 7, spindle body 41 comprises two halves or sections 60, 60 each having a semicircular or convex outer surface and a respective mating or inner surface 61, 61 on which are located pins 62, 62 for engagement within holes 63, 63 on the opposite mating surface. Each mating surface also includes a peg 64 for engagement within a slot 65 on the opposite mating surface. The pins, holes, pegs and slots described in the two preceding sentences serve to hold the two spindle halves 60, 60 together. Each mating surface 61 on a spindle body half 60 contains a first slot portion 67 extending in a direction substantially parallel to the axis of the spindle. Communicating with each first slot portion 67 is a second slot portion 68 extending transversely from the first slot portion to the outer surface of the spindle where it communicates with a corresponding groove 53. When the two spindle halves 60, 60 are mated, the slot portions 67, 67 and 68, 68 on each half are similarly mated to define channels for receiving the first and second portions 55, 56 respectively of an electrical conducting element 42.

Figure 8:
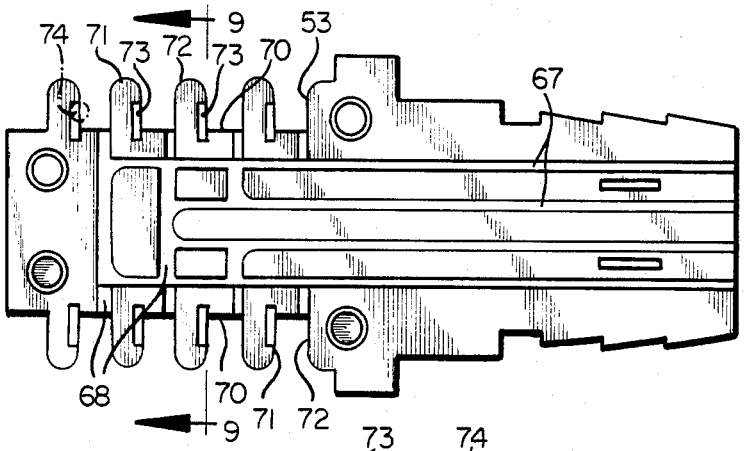
FIG. 8 is a plan view of one-half of a split spindle body in accordance with the present invention.
Figure 9:
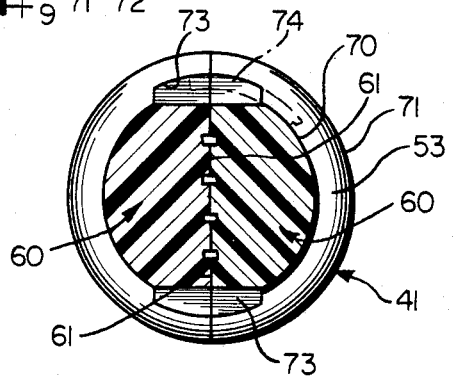
FIG. 9 is a sectional view taken along line 9—9 in FIG. 8 but with both halves of the spindle body assembled together.

Referring now to FIGS. 7–9, each ring portion 57 of an electrical conducting element is wrapped around the outer surface of the spindle body within a groove 53. Each groove 53 comprises a bottom 70 and a pair of side walls 71, 72. Located in side wall 71 of each groove, adjacent groove bottom 70, is a notch 73 which receives and engages the terminal end part 74 of an electrical conducting element's ring portion 57, to retain terminal end part 74 adjacent the bottom of groove 53 and maintain the entire ring portion in close engagement with the bottom of groove 53. Notch 73 prevents the ring portion from disengaging from groove bottom 70. As shown in FIG. 8, each notch 73 extends radially inwardly toward the axis of the spindle, further than does groove bottom 70. This enhances the moldability of the notch.

Each groove 53 has a width sufficient to accomodate two widths of the conductor material of which ring portion 57 is composed but not substantially more. The significance of this feature will be discussed below.

Referring now to FIGS. 2–6, each electrical contact member 50 comprises a first portion 80 for engagement with an electrical contact member on male electrical connector element 31, a second portion 81 extending from first portion 80 in a direction substantially parallel with the axis of the spindle body and lying in the same plane as first portion 80, and a third portion 82 integral with second portion 81 and extending transversely to the plane of first and second portions 80, 81. First and second portions 80, 81 have a junction 83 therebetween, and second and third portions 81, 82 have a junction 84 therebetween. Third portion 30 normally abuts the spindle within a peripheral groove 53.

Groove 53 contains two widths of the conductor material of an electrical conducting element's ring portion 57. Third portion 82 of an electrical contact member engages the peripheral groove containing two widths of the conductor material (FIG. 4). Because the two widths of conductor material completely fill a groove 53, a full electrical connection between electrical contact member 50 and ring portion 53 is assured. There is no danger of third contact portion 82 slipping off a ring portion into a part of the groove not occupied by the ring portion because the totality of the width of the groove is occupied by the two widths of conductor material.

As shown in the drawings, there are four peripheral grooves 53, 53 on the spindle body. There are also four electrical contact members 50, 50 carried by female connector element 48. The third portion 82 of each contact member 50 engages a respective peripheral groove 53. In the illustrated embodiment, a pair of third portions 82, 82 engages the spindle body on each of two opposite sides, (FIG. 6), and the engagements are all tangential to the spindle body at locations on the spindle body below the axis thereof. Each of the four third portions 82, 82 is under torsion so that the two pairs of third portions 82, 82 apply between them a pinching or gripping action on the spindle body from opposite sides of the spindle body, and this helps effect the attachment between female connector element 48 and spindle body 41, an attachment which is effective outside of housing 36, as well as inside the housing. The engagement of a ring portion 57 by contact portions 82, 82 from opposite sides of a groove 53 also helps to reduce noise in the receiver. This is because noise is due to discontinuities in engagement between a ring portion 57 and a third portion 82 during rotation of one relative to the other. With two third portions 82, 82 engaging each ring, the incidence of discontinuity is reduced substantially and therefore so is the noise. Another benefit of engaging each ring portion 57 with two third portions 82, 82 is that a third portion 82 need not be pressed so tightly against a ring portion to avoid noise, and as a result, the torque required to rotate the spindle against the resistance imparted by third portions 82, 82 is substantially reduced, e.g. to about 25% of the torque required when a ring portion 57 is engaged by only one third portion 82.

Female connector element 48 includes structure which facilitates the alignment of each contact member's third portion 82 with a respective peripheral groove 53. More particularly, female connector element is in the form of a body having a bottom portion 86, a pair of side portions 87, 88 extending upwardly from bottom portion 86 and an end portion 89 also extending upwardly from bottom portion 86 and extending between side portions 87, 88. End portion 89 comprises a plurality of slots 90, 90 each for containing the terminal end part 85 of a first portion 80 of an electrical contact member 50. Located on the female connector element's bottom portion 86 are a plurality of slots 91, 91 each for containing a second portion 81 of electrical contact member 50.

Communicating with all of slots 91, 91, at an end 93 of female connector element 48, is a notch 92 for receiving junction 83 between first and second portions 80, 81 of a contact member 50. Notch 92 comprises structure for accommodating movement of contact member 50 in the plane of its portions 80, 81 toward and away from spindle body 41 along a path parallel to the axis of the spindle. This permits alignment of the contact member's third portion 82 with a predetermined peripheral groove 53 on spindle body 41. Slots 90, 90 in end portion 89 of the female connector element have a dimension, in an axial direction, greater than the width of groove 53 (see FIG. 4) and sufficient to accommodate the movement described in the next to last sentence.

As noted above, third portion 82 of electrical contact member 50 is under torsion, and structure for accomplishing this will now be described. The female connector element's bottom portion 86 comprises structure including slot 91, which mounts the contact member's third portion 82 and junction 84 for rotation about the axis of second portion 81 of the contact member. Located on the upper part of the female connector element's bottom portion 86 are slots 95, 95 each for receiving and containing a part 96 of the connector member's first portion 80, adjacent junction 83 thereof. The structure described in the preceding sentence holds junction 83 against rotation about the axis of the contact member's second portion 81. In effect, the contact member's second portion 81 is restrained against rotation at an end thereof defined by junction 83, but it is not restrained against rotation at an end thereof defined by junction 84. As a result, second portion 81 of the contact member constitutes a torsion bar urging the contact member's third portion 82 against spindle body 41 toward a free state position for third portion 82. This free state position, indicated by dash dot lines at **82*a* in FIG. 6 is located angularly substantially inwardly of the position where third portion 82 normally abuts the spindle, the normal position being indicated in full lines at 82 in FIG. 6. Indicated by dash dot lines at 82*b* in FIG. 6 is the maximum torsional limit for third portion 82**.

The amount of torsion (i.e. angle of twist) which is applied to the contact member's third portion 82 is determined by the length of the torsion bar, that is by the length of the contact member's second portion 81 between its unrestrained end at junction 84 and its restrained end at junction 83. If more torsion or angle of twist is desirable, this can be accomplished by increasing the length of the torsion bar (second portion 81). If torsion bar 81 is lengthened, then female connector element 48 must be lengthened to accommodate the increase in torsion bar length, and this can be accomplished by increasing the thickness or dimension in an axial direction of end portion 89 of the female connector element. (The distance between end 93 and end portion 89 of the female connector element is dictated by the dimension needed to accommodate male modular connector element 31. Because the size of male element 31 is fixed, female connector element 48 cannot be lengthened between end 93 and end portion 89 thereof. Hence the increase in the length of torsion bar 81 must be accommodated by increasing the thickness of the female connector element's end portion 89.)

Figure 6A:
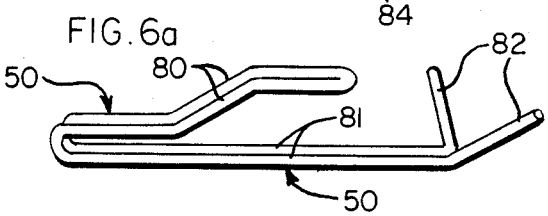
FIG. 6*a* is a perspective of an embodiment of electrical contact member in accordance with the present invention.

In the embodiments discussed above, there is a single contact member 50 and a single third portion 82 for each peripheral spindle groove 53. In another embodiment, there can be a pair of contact members 50, 50 for each peripheral spindle groove 53, with the third portion 82 of each contact member in the pair engaging groove 53 from a respective opposite side. In such an embodiment each contact member in the pair has first and second portions 80, 81 each disposed in close side-by-side relation with the first and second portions of the other contact member in the pair, and portions 80, 81 of each contact member in the pair lie in the same slot 90, 91, 95. The third portion 82 of each contact member in the pair diverges from the third portion of the other contact member in the pair. This can be accomplished by making each contact member from a separate wire or from one wire doubled to form the portions 80, 81, 82 of the two contact members, as shown in FIG. 6*a*.

The slots 90, 91, 95 etc. should be wide enough to accommodate both members 50, 50 or the members 50, 50 should be narrow enough to both fit in the same slot. Each contact member 50 in the pair has the torsion bar characteristics described above for an unpaired contact member 50, so that there is a double torsion bar effect urging each of the third portions 82, 82 in a pair toward each other from opposite sides of the same peripheral spindle groove.

As noted above, each first portion 80, 80 in a pair lies in the same slot 90, and each first portion 80, 80 in a pair is engaged by the same contact member 97 in male modular connector element 31 (FIG. 1).

There will now be described various embodiments for facilitating the assembly of electrical conducting elements 42, 42 with spindle body 41 and for maintaining the electrical conducting elements in insulated relation to each other.

Referring to FIGS. 13–16, spindle body 41 has a pair of opposite ends 100, 101 and an outer surface 102. In this embodiment, shank 45 would also function as a bearing portion, like portion 43 in the embodiment of FIGS. 2 and 4. Spindle body 41 also comprises an axial opening 103 extending between opposite ends 100, 101. Axial opening 103 slidably receives an elongated holding member 104 having an outer surface 107 containing a plurality of peripheral grooves 108, 108. Holding member 104 comprises a key 105 extending radially outwardly therefrom, and spindle body 41 comprises a key way 106 at axial opening 103 for receiving key 105 to fix holding member 104 against rotation about the axis of spindle body 41 when the holding member is slidably received within axial opening 103.

An electrical conducting element 42 is received in each groove 108 on holding member 104, before the holding member is slidably inserted into the spindle body's axial opening 103. Holding member 104 is composed of electrical insulating material, and when the holding member is received within the spindle body, the holding member and the spindle body cooperate to maintain electrical conducting elements 42, 42 in insulated relation to each other.

Figure 16:
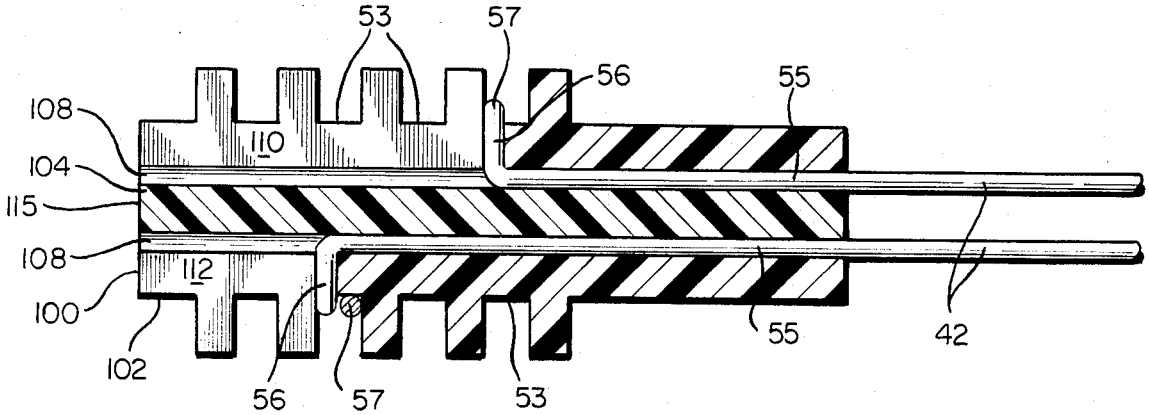
FIG. 16 is a sectional view taken along line 16—16 in FIG. 15.

When holding member 104 is assembled within spindle body 41, the holding member's elongated grooves 108, 108 each extend in a direction parallel to the axis of the spindle body, and each comprises structure for holding the first portion 55 of a respective electrical conducting element 42 (FIG. 16).

The spindle body comprises structure for facilitating the fabrication of electrical conducting element 42 into its component portions 56, 57, and such structure will now be described. Extending radially inwardly from outer surface 102 of spindle body 41 are a plurality of slots 110, 111, 112, 113 each extending from spindle body end 100 toward the other end 101 in a direction parallel to the spindle body's axis, and each slot 110–113 terminates at a respective one of the spindle body's peripheral grooves 53, 53. Grooves 53, 53 are separated by dividers integral with spindle body 41, and each slot 110–113 terminates between a pair of adjacent dividers. Each slot 110–113 extends in a different respective radial direction transverse to the axis of spindle body 41, and when holding member 104 has been slidably inserted within spindle body 41, each of the elongated grooves 108, 108 on the holding member is radially aligned with a respective slot 110–113 in spindle body 41. Each of slots 110–113 is angularly spaced from the other, and each of the elongated grooves 108, 108 in the holding member is angularly spaced from the other at a spacing corresponding to the angular spacing of slots 110–113.

When holding member 104 is initially inserted within spindle body 41, holding member end 115 is aligned with spindle body end 100 (FIG. 16) and an end part 47 on each undeformed electrical conducting element 42 extends axially outwardly past spindle body end 100. End part 47 is grasped and bent back, through a corresponding respective slot (e.g. 110) in spindle body 41, all the way to the particular peripheral groove 53 at which that particular slot terminates. This bending action forms second portion 56 of electrical conducting element 42. The remainder of the electrical conducting element is then wrapped around the outer surface of spindle body 42 within its peripheral groove 53, thereby forming ring portion 57 of the electrical conducting element.

The sequence of fabricating operations described in the preceding paragraph is repeated for each of the electrical conducting elements 42, 42. When the electrical conducting elements have been thus fabricated into their respective component portions, each of slots 110–113 contains the second portion 56 of an electrical conducting element. Slots 110–113 facilitate the wrapping of the electrical conducting element's ring portion 57 around the outer surface 102 of spindle body 41 within a respective spindle body peripheral groove 53.

Referring now to FIGS. 17–20, in the embodiment illustrated in these figures, spindle body 41 has a single slot 116 extending radially inwardly from the spindle body's outer surface 102. Slot 116 also extends along the axis of the spindle body from one spindle body end 100 to an end wall 122 adjacent the other spindle body end 101, and slot 116 communicates with all of the peripheral grooves 53, 53 on spindle body 41. Slot 116 terminates at a groove 53 which is relatively remote from spindle body end 100 and which is defined by a pair of adjacent dividers integral with the spindle body. Slot 116 slidably receives a holding member 117 for holding electrical conducting elements 42, 42 in insulated relation to each other. Slot 116 mounts holding member 117 in a predetermined position within spindle body 41, fixed against movement in a direction transverse to the axis of the spindle body.

Holding member 117 comprises a pair of radially spaced, flat side surfaces 118, 119 and a pair of axially spaced opposite ends 120, 121. End 120 is inclined in a direction non-perpendicularly transverse to the axis of the spindle body, and end 120 is located closer to end 100 of the spindle body then is the other end 121 of holding member 117. The holding member's flat side surface 118 has a plurality of grooves 123, 123 extending between the holding member's ends 120, 121. Each groove 123 comprises structure for holding the first portion 55 of a respective electrical conducting element.

Before holding member 117 is inserted in slot 116, an electrical conducting element 42 is placed in each of the grooves 123, 123 of the holding member. The holding member is then slidably inserted into slot 116 until end wall 121 of holding member 117 abuts against the inner surface of end wall 122 adjacent spindle body end 101 (FIG. 18). End wall 122 contains a plurality of aligned openings 132, 132 through each of which a respective electrical conducting element 142, 142 extends. Each groove 123, 123 in holding member 117 has a different dimension in an axial direction so that, when holding member 117 is positioned within spindle body 41 as shown in FIG. 18, each end of a groove 123, 123 at inclined end 120 is radially aligned with a different respective peripheral groove 53, 53 on spindle body 41.

When holding member 117 is initially inserted into spindle body 41, the end parts 47, 47 of electrical conducting elements 42, 42 extend axially outwardly from spindle body 41 beyond end 100 thereof. In order to fabricate the electrical conducting elements 42, 42 into their respective component portions, the end part 47 of each electrical conducting element is grasped and bent back in an axial direction through slot 116 until it is radially aligned with a respective peripheral groove 53 on the spindle body. In the course of doing so, the electrical conducting element's second portion 56 is formed. The remainder of end part 47 is then wrapped around the outer surface of spindle body 41 within a respective peripheral groove 53. The bending and wrapping procedures described above are performed on end parts 47, 47 sequentially from top to bottom as viewed in FIGS. 17–18.

As shown in FIG. 20, slot 116 has a relatively wide inner portion 124 for receiving holding member 117 and a relatively narrow outer portion 125 for receiving the second portion 56 of an electrical conducting element. Slot portion 125 is narrower than the width of holding member 117, and as a result, the holding member is restrained against movement in a radial direction parallel to its side surfaces 118, 119.

Referring now to FIGS. 21–24, the embodiment illustrated therein is similar to that illustrated in FIGS. 17–20, except that instead of employing a single holding member composed of electrical insulating material, such as 117, the embodiment of FIGS. 21–24 employs a plurality of electrical insulating layers 130, 130 each enclosing part of a separate, respective electrical conducting element 42.

More particularly, each electrical conducting element 42, 42 has its first portion 55 surrounded by circular insulating layer 130 having a pair of opposite ends 131, 133. Each insulating layer 130 has a different respective dimension in an axial direction.

Extending radially inwardly from the outer surface 102 of spindle body 41 is a slot 126 extending from one spindle body end 100 toward the other end 101 in a direction parallel to the axis of the spindle body. Slot 126 comprises a plurality of radially spaced, connected grooves 127, 127 each defining a circular cross-section, and the outermost groove 127 communicates with a narrow, outermost slot portion 128 in turn communicating with each of the peripheral grooves 53, 53 on the outer surface of the spindle body. Each circular groove 127 receives and holds in a fixed position in the spindle body, a respective tubular, cylindrical insulating layer 130 having an annular cross-section.

Each of the insulated electrical conducting elements 42, 42 is inserted into the spindle body until the insulating layers 130, 130 are in the position shown in FIG. 23 wherein an end 133 of the insulating layer abuts against the inner surface of a spindle body end wall 134 adjacent spindle body end 101. End wall 134 has a plurality of openings 135, 135 through each of which extends an uninsulated part of a respective electrical conducting element 42. End 131 of the insulating layer is located closer to end 100 of the spindle body. When the electrical conducting elements 42, 42 are in the position shown in FIG. 23, each insulating layer end 131 is radially aligned with a respective spindle body peripheral groove 53.

After electrical conducting elements 42, 42 have been inserted in slot 126, the terminal end 47 of each element 42 is grasped and bent back axially through slot 126 until it is aligned with a respective peripheral groove 53 in the spindle body, thus forming second portion 56 of the electrical conducting element. The remainder of the electrical conducting element is then wrapped around the outer surface of the spindle body in its respective peripheral groove 53 to form ring portion 57 of the electrical conducting element. The bending and wrapping procedures described above are performed on end parts 47, 47 sequentially from top to bottom as viewed in FIGS. 21 and 23.

Figure 11:
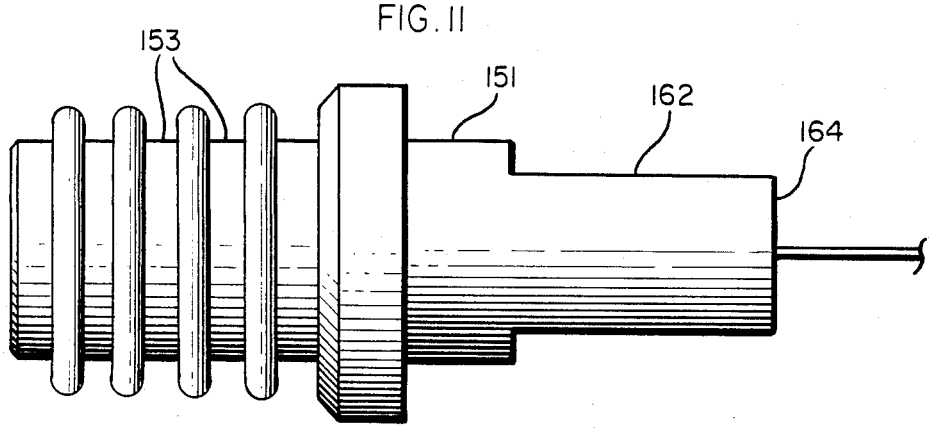
FIG. 11 is a side elevational view of the embodiment whose assembly is depicted in FIG. 10.
Figure 12:
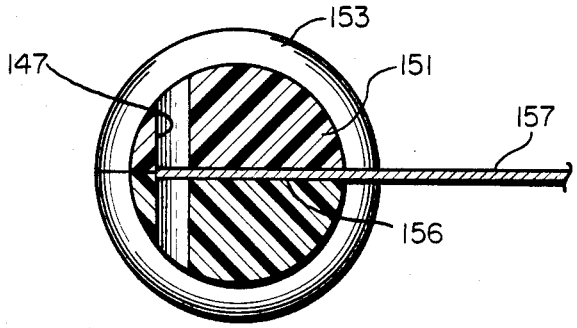
FIG. 12 is a sectional view taken along line 12—12 in FIG. 10.
Figure 10:
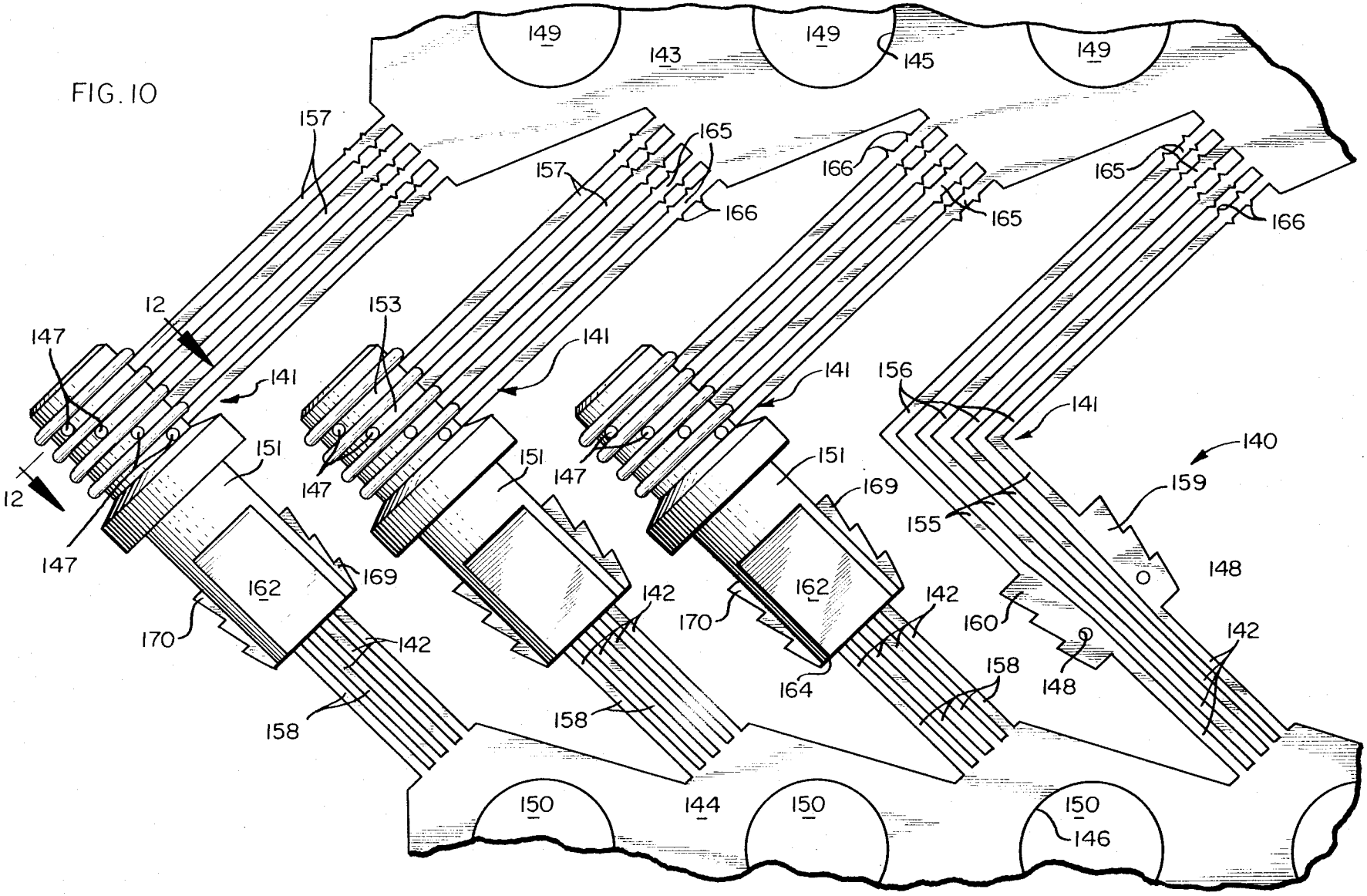
FIG. 10 illustrates a method of assembling an embodiment of a spindle assembly in accordance with the present invention.
Figure 13:
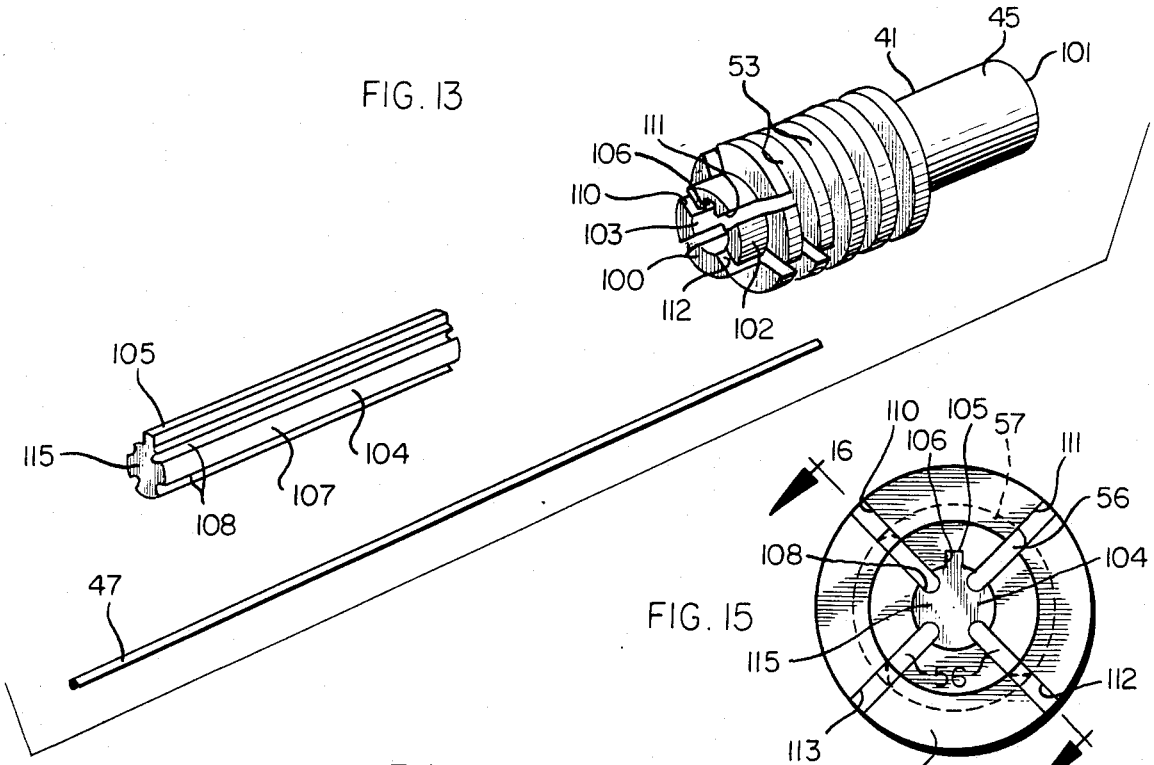
FIG. 13 is an exploded perspective of another embodiment of a spindle assembly in accordance with the present invention.
Figure 15:
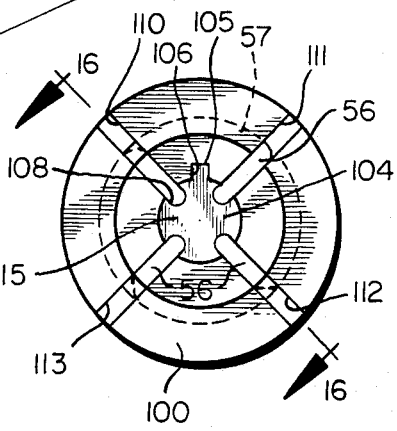
FIG. 15 is an end view, as viewed from the left in FIG. 14.
Figure 14:
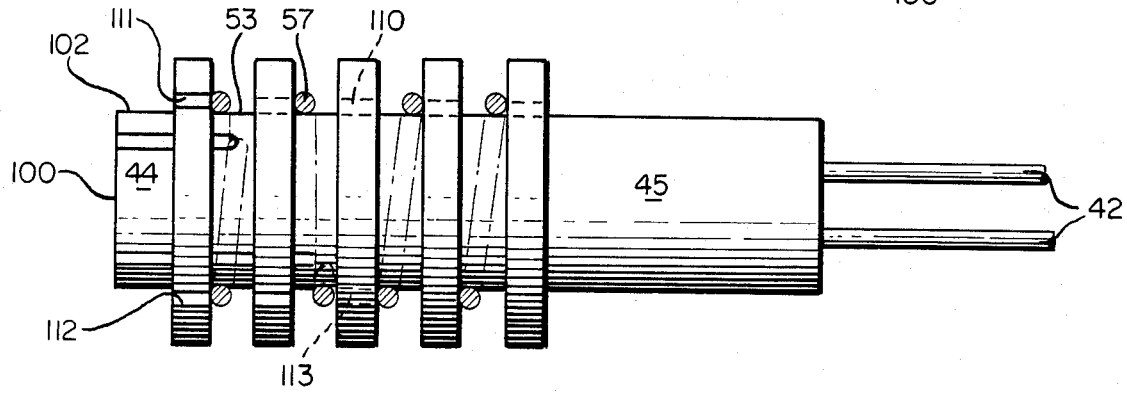
FIG. 14 is a side elevational view of the embodiment of FIG. 13.

FIGS. 10–12 depict a method for fabricating a spindle assembly wherein the electrical conducting elements are in planar form rather than wire as in the other embodiments described above.

Referring initially to FIG. 10, the method comprises initially providing a sheet of electrical conducting material (e.g. copper or the like). This sheet is stamped into an intermediate planar form 140 having a multiplicity of conducting groups 141, 141 each comprising a plurality of parallel, spaced apart, planar, electrical conducting elements 142, 142 each connected to a pair of marginal portions 143, 144 on intermediate planar form 140.

Intermediate form 140 is then positioned at a molding station accommodating a plurality of molds for forming spindle bodies. There is one mold for each conducting group 141, 141.

Each marginal portion 143, 144 has holes 145, 146 respectively for receiving pins 149, 150 attached to a conveying system (not shown). The pins received in holes 145, 146 hold intermediate form 140 in a fixed disposition at the molding station illustrated in FIG. 10 and convey the molded spindle bodies with electrical conducting elements embedded therein away from the molding station after the completion of the molding operation, which will be subsequently described.

Each electrical conducting group 141 on intermediate form 140 has portions 157, 157 each corresponding to the ring portion of an electrical conducting element, portions 158, 158 each corresponding to the portion of an electrical conducting element which is connected to male electrical connector element 33, and transversely extending barb portions 159, 160. Portions 157–160 are unenclosed by the mold at the molding station, but all the other portions of a conducting group 141 are enclosed, as shown with respect to the three conducting groups 141, 141 to the left in FIG. 10.

There are four molds at the molding station, and each mold is a cavity mold of conventional construction composed of two halves held in place by pins located at 147 (FIG. 10). After the molds have been positioned for all four conducting groups 141, 141 of an intermediate planar form 140, a non-conducting, plastic material in molten form is introduced into each mold. The molten plastic material is then solidified around the enclosed part of each group 141 to embed the enclosed portions within a molded plastic spindle body 151. Each conducting element 142 in each conducting group 141 has a pair of free unembedded parts, one such part corresponding to ring portions 157, 157 and the other such part corresponding to portions 158, 158. Portions 157, 158 are respectively connected to marginal portions 143, 144 of planar intermediate form 140.

Each electrical conducting group 141 comprises openings 148, 148 which fill with plastic during the molding operation to help lock the group in place within the molded plastic spindle body 151 and help hold barbed portions 159, 160 in place when the spindle assembly is in final form.

After the molten plastic material has solidified, the molds are opened to effect the separation therefrom of a one-piece, molded, plastic spindle body 151 with electrical conducting elements embedded therein. All of the spindle bodies at this stage are connected together by the marginal portions 143, 144 of planar form 140.

The assemblage of molded spindle bodies 151, 151 with embedded electrical conducting elements 142, 142 and connected marginal portions 143, 144 are then conveyed by pins 149, 150 extending through marginal holes 145, 146 to another station where the marginal portions 143, 144 are severed from the unembedded portions 157, 158 of each conducting element to form individual, separated spindle bodies with conducting elements 142, 142 embedded therein. Thereafter, each unembedded part corresponding to a ring portion 157 is wrapped around the outer surface of the corresponding spindle body 151 in a groove 153 formed therein during the molding step.

In its final form, the spindle assembly comprises, in addition to the spindle body, a plurality of electrical conducting elements 142, 142 each having a planar first portion 155 extending through the spindle body in a direction substantially parallel to the axis of the spindle body, a second planar portion 156 extending transversely from the first portion through the outer surface of the spindle body and a ribbon-like ring portion 157 integral with the second portion and received in a respective peripheral groove 153 on the spindle body.

As shown in FIG. 10, in each group of conducting elements 142, 142, the two outermost conducting elements have portions 159, 160 extending radially outwardly, on opposite sides of the conducting element, adjacent an end 164 of the spindle body, at a location axially spaced from the peripheral grooves 153, 153. Portions 159, 160 terminate at barbs. The location and shape of portions 159, 160 correspond to the location and shape of portions 169, 170 on the spindle shank 162 on which a male connector element 33 is mounted. Portions 169, 170 comprise structure for embeddingly engaging with the male electrical connector element to help hold it in place on shank 162.

As noted above, each ribbon-like portion 157, 157 is wrapped around the outer surface of the spindle body at a respective groove 153, 153. Each ring portion has a terminal end part 165, comprising barbs 166, 166 for embedding engagement with the side walls of a peripheral groove 153 to help hold the ring portion 157 in place in the groove.

Referring to FIG. 12, there is an opening 147 in spindle body 151 which corresponds to the location of the pins which held the two halves of a cavity mold in place during the molding step.

Referring again to FIG. 10, in lieu of a manufacturing method in which one-piece spindle bodies are molded about the electrical conducting elements, one may employ a method utilizing pre-molded spindle body sections or halves similar to those illustrated in FIG. 7 at 60, 60. In such a method, intermediate form 140 would be positioned at a station accommodating a plurality of spaced spindle body sections or halves 60, 60, as in FIG. 10. There, each group 142 of electrical conducting elements 141, 141 would be placed atop a respective spindle body section or half 60 each having longitudinal and lateral slot portions such as 67, 68 (FIG. 2) appropriately sized and shaped to accommodate flat first and second portions 155, 156 of an electrical conducting element 142 as well as flat edge portions 159, 160 on the two outermost elements. Then another, similarly contoured spindle body half 60 would be placed atop each conducting group 42 and engaged to the lower spindle half through the medium of pins and holes 62, 63 and pegs and slots 64, 65 (FIG. 7). Next, the opposite ends of conducting elements 42, 42 would be severed from marginal portions 143, 144. The ribbon-like portions 157, 157 are then wrapped within their respective grooves and the rest of the manufacturing operation is as described above.

The foregoing detailed description has been given for clearness of understanding only, and no unnecessary limitations should be understood therefrom, as modifications will be obvious to those skilled in the art.

I claim:

1. A spindle assembly for a rotatable electrical connector, said spindle assembly comprising:

a spindle body composed of electrical insulating material and having an axis and an outer surface;

a plurality of peripheral grooves on said outer surface;

a plurality of electrical conducting elements each having a first portion extending through said spindle body in a direction substantially parallel to said axis, a second portion extending transversely from said first portion through the outer surface of said spindle and a ring portion integral with said second portion and received in a respective peripheral groove;

each ring portion having a terminal end part;

each groove having a bottom and a pair of side walls;

a notch in a side wall of each groove adjacent the bottom of the groove;

said notch comprising means for receiving and engaging said terminal end part of the ring portion received in that groove to retain the terminal end part adjacent the bottom of the groove.

2. A spindle assembly as recited in claim 1 wherein:

said notch extends radially inwardly toward said axis further than the bottom of said groove.

3. A spindle assembly as recited in claim 1 wherein:

said ring portion is composed of conductor material having a predetermined width;

said groove has a width sufficient to accommodate two widths of said conductor material but not substantially more;

and said groove contains two widths of said conductor material, to substantially fill said groove across its width.

4. In combination with the spindle assembly recited in claim 3:

an electrical contact member having a portion engaging the peripheral groove containing two widths of said conductor material;

said two widths of conductor material and the width of said groove comprising means cooperating to avoid a situation wherein said engaged portion of the electrical contact member could slip off the ring portion into a part of the groove not occupied by the ring portion.

5. A spindle assembly for a rotatable electrical connector, said spindle assembly comprising:

a spindle body composed of electrical insulating material and having an axis and an outer surface;

a plurality of peripheral grooves on said outer surface;

a plurality of electrical conducting elements carried by said spindle body;

each conducting element having a ring portion received in a respective peripheral groove;

said ring portion being composed of conductor material having a predetermined width;

said groove having a width sufficient to accommodate two widths of said conductor material but not substantially more;

and said groove contains two widths of said conductor material, to substantially fill said groove across its width.

6. In combination with the spindle assembly recited in claim 5:

an electrical contact member having a portion engaging the peripheral groove containing two widths of said conductor material;

said two widths of conductor material and the width of said groove comprising means cooperating to avoid a situation wherein said engaged portion of the electrical contact member could slip off the ring portion into a part of the groove not occupied by the ring portion.

7. In a rotatable electrical connector:

a spindle body composed of electrical insulating material and having an axis of rotation;

said spindle body comprising a pair of members each having an outer surface and an inner surface;

said spindle body members extending in an axial direction alongside each other with said inner surfaces in facing relation;

one of said members being mounted on the other member to form said spindle body;

said spindle body having an outer surface defined by both outer surfaces of said two members;

a plurality of peripheral grooves on said outer surface of the spindle body;

a plurality of electrical conducting elements each having a first portion extending through said spindle body between said spindle body members, in a direction substantially parallel to said axis, a second portion extending transversely from said first portion between said spindle body members and through the outer surface of said spindle body, and a ring portion integral with said second portion;

each ring portion being wrapped around the outer surface of said spindle body within a respective peripheral groove;

a housing having an opening for receiving said spindle body and an axis of rotation coinciding with said spindle body axis;

means on said housing and on said spindle body cooperating to mount each of said spindle body and said housing for rotation about said axis independent of rotation of the other;

an electrical connector element having a plurality of electrical contact members each having opposite ends;

means mounting said electrical connector element and said contact members for rotational movement with said housing;

means at one end of each electrical contact member for engagement with an electrical contact member on another electrical connector element which is mateable with said first recited electrical connector element;

and means at the other end of each electrical contact member for electrically engaging the ring portion of an electrical conducting element and for maintaining said engagement during rotation of one of said spindle body and said housing relative to the other.

8. In combination with the rotatable electrical connector of claim 7:

a third electrical connector element, having a plurality of electrical contact members each electrically connected to the first portion of one of said electrical conducting elements;

and means for electrically connecting (a) said third electrical connector element and (b) said second recited electrical connector element each to a respective one of either (c) a telephone hand set or base or (d) a telephone cord.

9. In combination:

a spindle body composed of electrical insulating material and having an axis and an outer surface;

a plurality of peripheral grooves on said outer surface;

a plurality of electrical conducting elements carried by said spindle body and each having a ring portion received in a respective peripheral groove;

a female electrical connector element aligned with the axis of said spindle body and comprising a second body composed of electrical insulating material;

a plurality of electrical contact members carried by said second body;

each contact member comprising a first portion for engagement with an electrical contact member on a male electrical connector element, a second portion extending from said first portion in a direction substantially parallel with said axis of the spindle body and lying in the same plane as said first portion, and a third portion integral with said second portion and extending transversely to the plane of said first and second portions;

said first and second portions having a junction therebetween;

said third portion normally abutting said spindle body within a peripheral groove;

and notch means on said second body for receiving the junction between the first and second portions of the contact member and for accommodating movement of the contact member in said plane toward and away from the spindle body along a path parallel to said axis, to align said third portion of the contact member with a predetermined peripheral groove on said spindle;

said notch means having a dimension, in an axial direction, greater than the width of said peripheral groove within which said third portion abuts said spindle body.

10. In the combination of claim 9 wherein:

said second and third portions of the contact member have a junction therebetween;

said third portion normally abuts said spindle within a peripheral groove;

means, on said second body, mounting said third portion, and said junction between the second and third portions of the contact member, for rotation about the axis of said second portion;

and means on said second body for holding said junction, between the first and second portions of the contact member, against rotation about the axis of said second portion;

said second portion of the contact member constituting torsion bar means urging said third portion of the contact member against said spindle body toward a free state position for said third portion, said free state position being located angularly substantially inwardly of the position where said third portion normally abuts said spindle body.

11. In combination:

a spindle body composed of electrical insulating material and having an axis and an outer surface;

a plurality of peripheral grooves on said outer surface;

a plurality of electrical conducting elements carried by said spindle body and each having a ring portion received in a respective peripheral groove;

a female electrical connector element aligned with the axis of said spindle body and comprising a second body composed of electrical insulating material;

a plurality of electrical contact members carried by said second body;

each contact member comprising a first portion for engagement with an electrical contact member on a male electrical connector element, a second portion extending from said first portion in a direction substantially parallel with said axis of the spindle body and lying in the same plane as said first portion, and a third portion integral with said second portion and extending transversely to the plane of said first and second portions;

said first and second portions having a junction therebetween;

said second and third portions of the contact member have a junction therebetween;

said third portion normally abutting said spindle within a peripheral groove;

means, on said second body, mounting said third portion, and said junction between the second and third portions of the contact member, for rotation about the axis of said second portion;

and means on said second body for holding said junction, between the first and second portions of the contact member, against rotation about the axis of said second portion;

said second portion of the contact member constituting torsion bar means urging said third portion of the contact member against said spindle body toward a free state position for said third portion, said free state position being located angularly substantially inwardly of the position where said third portion normally abuts said spindle body.

12. In combination:

a spindle body composed of electrical insulating material and having an axis and an outer surface;

a plurality of peripheral grooves on said outer surface;

a plurality of electrical conducting elements carried by said spindle body and each having a ring portion received in a respective peripheral groove;

a female electrical connector element associated with said spindle body and comprising a second body composed of electrical insulating material;

a plurality of electrical contact members carried by said second body;

each contact member comprising a first portion for engagement with an electrical contact member on a male electrical connector element, a second portion extending from said first portion toward said spindle body, and a third portion integral with said second portion and extending transversely to said second portion;

said first and second portions having a junction therebetween;

said third portion normally abutting said spindle body within a peripheral groove;

and notch means on said second body, for receiving the junction between the first and second portions of the contact member and for accommodating movement of the contact member toward and away from the spindle body, for engaging said third portion of the contact member with a predetermined peripheral groove on said spindle;

said notch means having a dimension, in an axial direction, greater than the width of said peripheral groove within which said third portion abuts said spindle body.

13. In combination:

a spindle body composed of electrical insulating material and having an axis and an outer surface;

a plurality of peripheral grooves on said outer surface;

a plurality of electrical conducting elements carried by said spindle body and each having a ring portion received in a respective peripheral groove;

a female electrical connector element associated with said spindle body and comprising a second body composed of electrical insulating material;

a plurality of electrical contact members carried by said second body;

each contact member comprising a first portion for engagement with an electrical contact member on a male electrical connector element, a second portion extending from said first portion toward the spindle body, and a third portion integral with said second portion and extending transversely to said second portion;

said first and second portions having a junction therebetween;

said second and third portions of the contact member have a junction therebetween;

said third portion normally abutting said spindle within a peripheral groove;

means, on said second body, mounting said third portion, and said junction between the second and third portions of the contact member, for rotation about the axis of said second portion;

and means on said second body for holding said junction, between the first and second portions of the contact member, against rotation about the axis of said second portion;

said second portion of the contact member constituting torsion bar means urging said third portion of the contact member against said spindle body toward a free state position for said third portion, said free state position being located angularly substantially inwardly of the position where said third portion normally abuts said spindle body.

14. In combination:

a spindle body composed of electrical insulating material and having an axis and an outer surface;

a plurality of peripheral grooves on said outer surface;

a plurality of electrical conducting elements carried by said spindle body and each having a ring portion received in a respective peripheral groove;

a female electrical connector element associated with said spindle body and comprising a second body composed of electrical insulating material;

a plurality of pairs of electrical contact members carried by said second body;

each pair of contact members being spaced from every other pair of contact members;

each contact member in a pair comprising a first portion for engagement with an electrical contact member on a male electrical connector element, a second portion extending from said first portion toward said spindle body, and a third portion integral with said second portion and extending transversely to said second portion;

said first and second portions of each member having a junction therebetween;

said second and third portions of each member have a junction therebetween;

each first and second portion of a paired contact member lying in close side-by-side relation with the first and second portion of the other contact member in the pair;

the third portions in each pair diverging from each other;

each of the two third portions in a pair normally abutting said spindle within the same peripheral groove, from respective opposite sides of the groove;

means, on said second body, mounting each third portion, of a paired member, and said junction between the second and third portions of that member, for rotation about the axis of said second portion;

and means on said second body for holding said junction, between the first and second portions of each paired member, against rotation about the axis of that member's second portion;

said second portion of each paired contact member constituting torsion bar means urging said third portion of that member against said spindle body toward a free state position for said third portion, said free state position being located angularly substantially inwardly of the position where said third portion normally abuts said spindle body.

15. A spindle assembly for a rotatable electrical connector, said spindle assembly comprising:

a spindle body composed of electrical insulating material and having an axis and an outer surface;

a plurality of peripheral grooves on said outer surface, separated by dividers integral with said spindle body;

a plurality of electrical conducting elements each having a first portion extending through said spindle body in a direction substantially parallel to said axis, a second portion extending transversely from said first portion through the outer surface of said spindle and a ring portion integral with said second poriton;

each ring portion having a free terminal end and being wrapped around the outer surface of said spindle body within a respective peripheral groove;

said spindle body having a pair of axially spaced opposite ends;

at least one slot extending inwardly from the outer surface of the spindle body, said slot extending from one end of the spindle body toward the other end in a direction parallel to said axis and terminating at one of said peripheral grooves between a pair of adjacent dividers;

said slot being aligned with the first portion of at least one electrical conducting element and communicating with said one peripheral groove;

said slot comprising means for receiving the second portion of said one electrical conducting element to facilitate the wrapping of the ring portion of that conducting element around the outer surface of the spindle body within its respective groove.

16. A spindle assembly as recited in claim 15 wherein:

said one slot communicates with all of said plurality of peripheral grooves;

and said spindle assembly comprises means for carrying the first portions of said electrical conducting elements in insulated relation to each other.

17. A spindle assembly as recited in claim 16 wherein:

said slot extends radially inwardly;

said carrying means comprises a plurality of tubular, cylindrical insulating layers each having an annular cross-section and each surrounding the first portion of a respective electrical conducting element;

and said slot comprises a plurality of radially spaced, connected groove means each defining a circular cross-section for receiving and holding, in a fixed position in said spindle body, a respective one of said insulating layers.

18. A spindle assembly as recited in claim 17 wherein:

said slot has an outer end at said outer surface of the spindle and an inner end spaced from said outer slot end in a radial direction;

each of said plurality of insulating layers has a different respective dimension in an axial direction, increasing sequentially from the outer slot end toward the inner slot end;

each insulating layer has a pair of opposite ends spaced apart in an axial direction;

one end of each insulating layer being located closer to said one end of the spindle body than is the other end of the insulating layer;

said one end of the insulating layer being radially aligned with a respective peripheral groove on the spindle body.

19. A spindle assembly as recited in claim 16 wherein:

said slot extends radially inwardly;

said carrying means comprises a holding member having a pair of radially spaced, flat side surfaces and a pair of axially spaced opposite ends;

one end of said holding member is located closer to said one end of the spindle body than is the other end of the holding member;

a plurality of grooves in a first of said flat side surfaces of the holding member and extending from one end of the holding member to the other end thereof;

each of said grooves comprising means for holding the first portion of a respective electrical conducting element;

said slot comprising means for slidably receiving said holding member and means for mounting said holding member in a predetermined position within said spindle body and fixed against movement in a direction transverse to the axis of the spindle body;

each groove in the holding member having said one end aligned in a radial direction with a respective peripheral groove on the outer surface of the spindle body when said holding member is in said predetermined position.

20. A spindle assembly as recited in claim 19 wherein:

said slot has a relatively wide inner portion for receiving said holding member and a relatively narrow outer portion for receiving the second portion of an electrical conducting element.

21. A spindle assembly as recited in claim 19 wherein:

said slot has an outer end at said outer surface of the spindle and an inner end spaced from said outer slot end in a radial direction;

each groove in the holding member has a different respective dimension in an axial direction, increasing sequentially from the outer slot end tward the inner slot end.

22. A spindle assembly as recited in claim 21 wherein:

said one end of the holding member is inclined in a direction non-perpendicularly transverse to said axis.

23. A spindle assembly as recited in claim 15 and comprising:

a plurality of said slots each terminating at and communicating with a respective peripheral groove in the spindle body, each slot being aligned with the first portion of a respective electrical conducting element and each receiving the second portion of said respective electrical conducting element;

each of said slots extending in a different respective direction transverse to said axis of the spindle body.

24. A spindle assembly as recited in claim 23 and comprising:

a holding member for carrying the first portions of each of said electrical conducting elements;

said spindle body comprising means for slidably receiving said holding member and means for mounting said holding member in a predetermined position within said spindle body and fixed against movement in a non-axial direction.

25. A spindle assembly as recited in claim 24 wherein:

said holding member comprises key means extending radially outwardly therefrom;

and said spindle body comprises a keyway for receiving said key means, to fix said holding member against rotation about the axis of the spindle body.

26. A spindle assembly as recited in claim 24 wherein:

each of said slots extends radially inwardly;

said holding member comprises an outer surface having a plurality of elongated grooves each extending in a direction parallel to the axis of said spindle body and each comprising means for holding the first portion of a respective electrical conducting element;

and each of said grooves is radially aligned with a respective slot in the spindle body when said holding member is received in said predetermined position in the spindle body.

27. A spindle assembly as recited in claim 26 wherein:

each of said slots is angularly spaced from the others;

and each of said grooves in said holding member is angularly spaced from the other at a spacing corresponding to the angular spacing of said slots.

28. A spindle assembly for a rotatable electrical connector, said spindle assembly comprising:

a spindle body composed of electrical insulating material and having an axis, an outer peripheral surface and a pair of opposite ends;

a plurality of peripheral grooves on said outer peripheral surface;

and a plurality of electrical conducting elements each having a planar first portion extending through said spindle body in a direction substantially parallel to said axis, a second planar portion extending transversely from said first portion through the outer surface of said spindle, and a ribbon-like ring portion integral with said second portion and received in a respective peripheral groove;

a pair of said conducting elements each having a portion extending radially outwardly adjacent an end of said spindle body at a location axially spaced from said peripheral grooves and terminating at barbs;

the location and shape of said outwardly extending portions on said pair of conducting elements corresponding to the location and shape of portions on said spindle body;

said spindle body comprising means, including said last recited spindle body portions, adjacent said spindle body end, for mounting a male electrical connector element;

said last recited means comprising means for embeddingly engaging with said male electrical connector element.

29. A spindle assembly as recited in claim 28 and wherein:

each ring portion has a terminal end part;

each groove has a bottom and a pair of side walls;

and each terminal end part comprises barbs for embedding engagement with the side walls of said peripheral groove.

30. A spindle assembly for a rotatable electrical connector, said spindle assembly comprising:

a spindle body composed of electrical insulating material and having an axis, an outer peripheral surface and a pair of opposite ends;

a plurality of peripheral grooves on said outer peripheral surface;

a plurality of electrical conducting elements each having a planar first portion extending through said spindle body in a direction substantially parallel to said axis, a second planar portion extending transversely from said first portion through the outer surface of said spindle, and a ribbon-like ring portion integral with said second portion and received in a respective peripheral groove;

each ring portion having a terminal end part;

each groove having a bottom and a pair of side walls;

and barb means on said ring portion, adjacent said terminal end part, for embedding engagement with the side walls of said peripheral groove.

31. A method for fabricating a spindle assembly, said method comprising the steps of:

providing a sheet of electrical conducting material;

stamping from said sheet an intermediate planar form having a pair of marginal portions and a multiplicity of conducting groups each comprising a plurality of parallel, spaced apart, planar, electrical conducting elements each connected to said pair of marginal portions;

positioning said intermediate form at a molding station accommodating a plurality of molds for forming spindle bodies;

holding said intermediate form in a fixed disposition at said molding station;

enclosing a part of each conducting group within a respective mold, while leaving unenclosed a pair of parts each connected to a respective marginal portion of said planar form;

introducing a non-conducting, plastic material in molten form into each mold;

solidifying said molten plastic material around the enclosed part of each group to embed said enclosed part within a molded plastic spindle body while leaving free and unembedded said parts connected to said marginal portions of the planar form;

opening said molds and separating from each a molded plastic spindle body with a plurality of electrical conducting elements embedded therein, all of said spindle bodies being connected together by the marginal portions of said planar form;

severing said marginal portions from the free, unembedded parts of each conducting group, to form individual, separated spindle bodies each having a plurality of conducting elements each comprising at least a pair of free, unembedded parts;

and wrapping one of the free, unembedded parts of each conducting element around the outer surface of the corresponding spindle body within which another part of the conducting element is embedded.

32. A method as recited in claim 31 wherein:

said stamping step comprises forming positioning holes in said marginal portions;

said method comprising providing mounting pins for said positioning holes at said molding station;

and said holding step comprises receiving said pins within said holes in the marginal portions.

33. A method for fabricating a spindle assembly, said method comprising the steps of:

providing a sheet of electrical conducting material;

stamping from said sheet an intermediate planar form having a pair of marginal portions and a multiplicity of conducting groups each comprising a plurality of parallel, spaced apart, planar, electrical conducting elements each connected to said pair of marginal portions;

positioning said intermediate form at a station accommodating a plurality of spaced spindle body sections;

holding said intermediate form in a fixed disposition at said station;

providing a plurality of first and second plastic spindle body sections, each of said first and second sections being engageable to form a whole spindle body;

superimposing a part of each conducting group with a respective first plastic spindle body section, while leaving unsuperimposed a pair of parts each connected to a respective marginal portion of said planar form;

placing a second plastic spindle body section atop each conducting group and engaging said first and second sections to form a whole spindle body and enclose part of each group within the resulting whole spindle body while leaving free and unenclosed said parts connected to said marginal portions of the planar form;

forming, as a result of the previously recited steps, a plurality of whole spindle bodies each having a plurality of electrical conducting elements enclosed therein, all of said spindle bodies being connected together by the marginal portions of said planar form;

severing said marginal portions from the free, unembedded parts of each conducting group, to form individual, separated spindle bodies each having a plurality of conducting elements each comprising at least a pair of free, unembedded parts;

and wrapping one of the free, unembedded parts of each conducting element around the outer surface of the corresponding spindle body within which another part of the conducting element is embedded.

34. A method of assembling a spindle for a rotary electrical connector, said method comprising the steps of:

providing a pair of spindle sections each having a convex outer surface and an inner surface;

providing a plurality of electrical conducting elements each having a linear first portion and a second portion extending transversely from said first portion;

placing each electrical conducting element on the inner surface of one of said spindle sections, at a respective predetermined location on said inner surface;

mounting the other spindle section on the one spindle section to hold said electrical conducting element between the inner surfaces of said spindle sections with part of the second portion of each conducting element projecting outwardly beyond the outer surfaces of the spindle sections;

said mounting step comprising forming a spindle having a circular outer surface;

and wrapping said projecting part of each electrical conducting element around said outer surface of the spindle at a respective predetermined location for each.

* * * * *